United States Patent [19]

Brattain

[11] 4,040,630

[45] Aug. 9, 1977

[54] PUZZLE

[76] Inventor: William G. Brattain, 806 E. Tacoma St., Ellensburg, Wash. 98926

[21] Appl. No.: 646,195

[22] Filed: Jan. 2, 1976

[51] Int. Cl.[2] ..... A63F 9/12

[52] U.S. Cl. ..... 273/157 R; 46/25

[58] Field of Search ..... 273/156, 157 R, 137 C, 273/160; 46/25, 30, 31

[56] References Cited

U.S. PATENT DOCUMENTS

| | | | |
|---|---|---|---|
| 1,809,508 | 6/1931 | Colby | 46/25 |
| 2,958,918 | 11/1960 | MacMillan | 46/25 X |
| 3,630,527 | 12/1971 | Breslow | 273/157 R |
| 3,806,127 | 4/1974 | Pink | 273/137 D |

*Primary Examiner*—Anton O. Oechsle
*Attorney, Agent, or Firm*—Seed, Berry, Vernon & Baynham

[57] ABSTRACT

A puzzle including a plurality of pieces each having a subset of coded symbols on its top and bottom surfaces. The pieces are adapted to fit together to form a closed structure when a plurality of symbols in the respective subsets of adjacent pieces match each other. In one embodiment, the pieces are arcuate blocks each having symbols formed by a plurality of peg arrangements extending from the top surface of the blocks, and correspoding aperture arrangements in the bottom surface of the block. The blocks are arranged end-to-end to form several courses, and the courses are stacked above each other with the blocks of one course overlapping two blocks of each adjacent course. However, the blocks may overlap each other only when their aperture arrangements match the peg arrangements of the blocks below. In another embodiment of the invention, the pieces are formed by a plurality of arcuate strips each having a plurality of spaced apart symbols. The strips overlap each other to form a continuous loop with a plurality of vertically adjacent symbols matching each other.

16 Claims, 7 Drawing Figures

FIG. 1
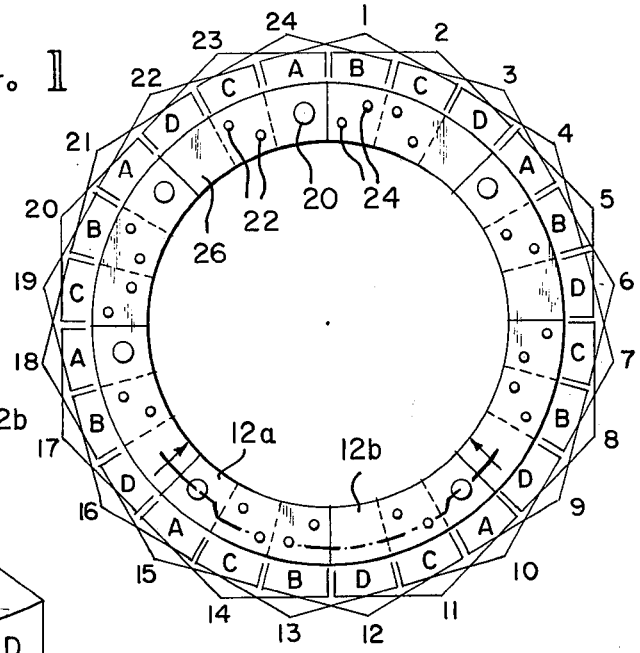
FIG. 2
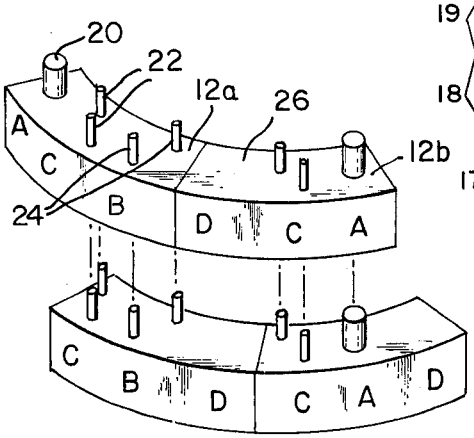
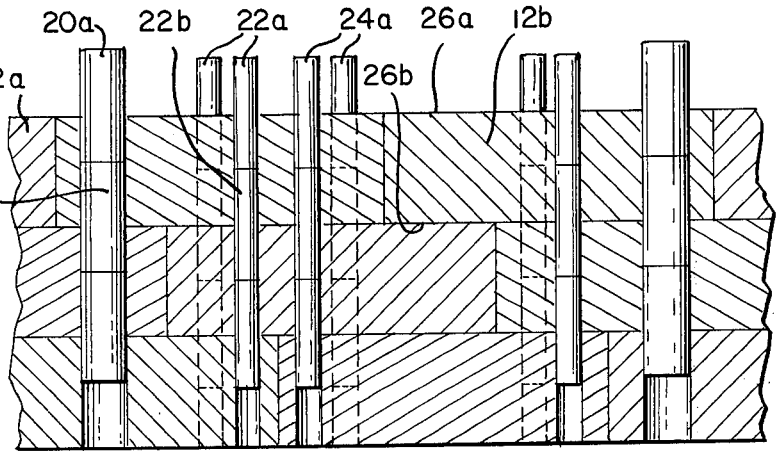
FIG. 3
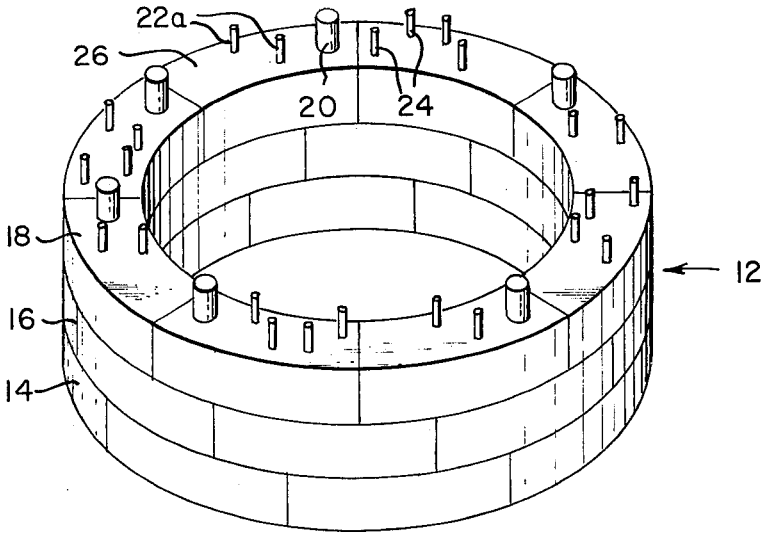
FIG. 4

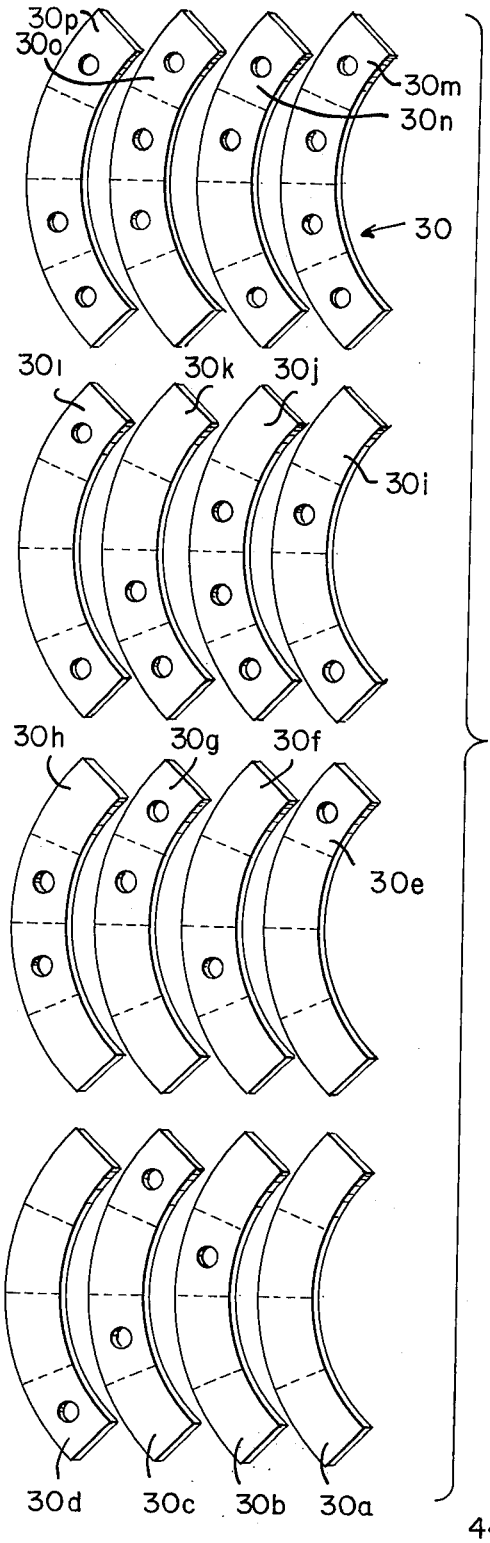
FIG. 5
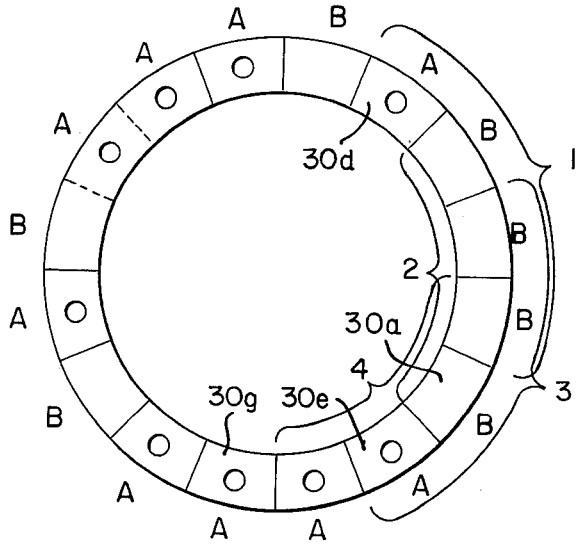
FIG. 6
FIG. 7
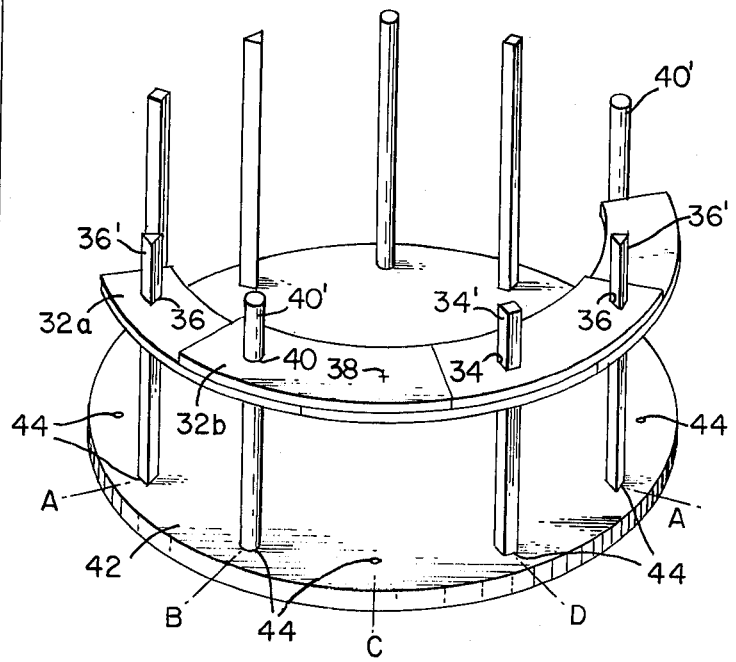

PUZZLE

BACKGROUND OF THE INVENTION

1. Field of the Invention

This invention relates to puzzles and, more particularly, to a puzzle having a plurality of pieces adapted to interlink with each other in a puzzle solution.

2.Description of the Prior Art

Many puzzles exist in which a plurality of puzzle pieces are assembled to form a unitary structure. In many of these conventional puzzles, the proper assembly of the pieces is easily memorized so that the puzzle does not present a continuing challenge to one who has previously solved the puzzle. Other conventional puzzles exhibit the opposite problem in that they are virtually impossible to solve usually because there is no systematic or logical process for assembling the pieces, and the entire assembly procedure is thus left solely to chance. In summary, many conventional puzzles, being either too difficult or too easy to assemble for the average person, do not provide the personal reward or satisfaction which an individual seeks in such puzzles.

SUMMARY OF THE INVENTION

It is an object of the invention to provide a puzzle in which the solution has a mathematical basis so that a systematic and logical procedure exists for assembling the puzzle pieces.

Another object of the invention is to provide a puzzle having a plurality of separate solutions thus making it difficult to memorize the proper assembly order so that the challenge of assembling the puzzle is preserved.

It is still another object of the invention to provide a puzzle in which several embodiments can be produced, each of which can be modified to increase or decrease the difficulty of solution.

These and other objects of the invention are provided by a plurality of puzzle pieces each having a subset of coded symbols taken from a set of such symbols. The puzzle pieces are adapted to mate with each other to form a closed structure when the symbols of one piece match at least one symbol in the subsets of adjacent pieces. In one embodiment, the puzzle pieces are arcuate blocks having symbols formed on their top surfaces by projecting pegs and on their bottom surfaces by apertures. The symbols are coded by providing several different peg and aperture arrangements with vertically aligned peg and aperture arrangements matching each other. The blocks are placed end-to-end to form a plurality of courses, and the courses are stacked above each other with the blocks of one course overlapping two blocks of each adjacent course. The arrangement of apertures on the bottom surface of each overlapping block receives corresponding peg arrangements on the top surface of the two blocks of the course below. In other embodiments of the invention, the pieces are formed by a plurality of arcuate strips each having a plurality of linearly spaced symbols. The strips overlap each other to form a continuous loop with vertically aligned symbols being identical.

BRIEF DESCRIPTION OF THE DRAWINGS

FIG. 1 is a top plan view of the puzzle of the first embodiment in assembled condition along with a schematic illustrating interlinking of symbols coded on the pieces.

FIG. 2 is an isometric view of the puzzle of FIG. 1 illustrating the puzzle pieces being assembled.

FIG. 3 is a cross sectional view taken along the line 3—3 of FIG. 1.

FIG. 4 is an isometric view showing the puzzle of the first embodiment in assembled condition.

FIG. 5 is a top plan view of the puzzle pieces of a second embodiment.

FIG. 6 is a top plan view showing the puzzle pieces of FIG. 5 in assembled condition.

FIG. 7 is an isometric view showing a third embodiment of the inventive puzzle.

DETAILED DESCRIPTION OF THE INVENTION

The mathematical basis for the inventive puzzle is best illustrated in FIGS. 1 and 2. For every set of symbols, e.g. ABCD, several subsets may be formed, e.g. AB. ABC. Where the set is comprised of four symbols taken in subsets of three non-repeating symbols at a time, 24 combinations or subsets exist. They are: ABC, ABD, ACB, ACD, ADB, ADC, BAC, BAD, BCA, BCD, BDA, BDC, CAB, CAD, CBA, CBD, CDA, CDB, DAB, DAC, DBA, DBC, DCA, and DCB. The 24 combinations listed above include a total of 72 symbols (3 symbols $\times$ 24 subsets). However, the 24 above listed subsets can be formed with only 24 symbols by properly interlinking symbols from adjacent subsets. For example, the subset ABC can be linked with the subset BCA as follows: ABCA, where the BC is common to both subsets. The subsets ABC, BCA and CAD may be formed by the following interlinked group: ABCAD, where the BC is common to the first and second subsets, the CA is common to the second and third subsets and the C is common to all three subsets. All of the 24 above listed subsets may be formed by 24 interlinked symbols when the symbols are placed in the proper order. Although there are several proper orders or solutions, one is illustrated in FIG. 1. Six of each of the symbols in the set (ABCD) are grouped into subsets of three symbols (e.g., ABC, BCD, etc.) to form 24 unique subsets. In other words, subset 1 (ABC) interlinks with subset 2 (BCD) so that the symbols BC are common to both subsets. Similarly, subset 2 (BCD) interlinks with subset 3 (CDA) so that the symbols CD are common to both subsets. Thus, the 24 subsets are formed by interlinking six of each of the four symbols in the set (ABCD). The symbols may also be interlinked to form the 24 subsets in different orders to provide different solutions. All embodiments of the inventive puzzle utilize this mathematical basis in which subsets of symbols derived from a set of such symbols are interlinked to form a closed loop.

The first embodiment of the inventive puzzle is illustrated in FIGS. 1-4. As best seen in FIG. 4, the puzzle pieces are formed from arcuate blocks, designated generally by reference numeral 12 which are arranged end-to-end to form a plurality of vertically stacked courses 14,16,18. The blocks of one course are offset from the blocks of the vertically adjacent course so that each block overlaps two of the blocks in the course below. A subset of symbols is coded on each block by several different peg arrangements. As illustrated in FIG. 2, one of the blocks, 12*a,* utilizes a relatively large diameter peg 20 as the symbol A; a pair of relatively small pegs 22 placed at one angle as the symbol C; a pair of relatively small pegs placed at the oppostie angle 24 for the symbol for B; and a second block, 12*b,* utilizes a blank 26, or the absence of any pegs, as the symbol D. As best illustrated in FIG. 3, the bottom surfaces of the blocks 12 contain symbols which are coded by apertures which are of identical shape and are arranged in the same pattern as the pegs directly above. For example, beneath the relatively large peg 20*a* of block 12*a* signifying an A is a relatively large aperture 20*b* filled with a mating peg from the block beneath. Similarly, directly beneath the pegs 22*a* signifying the letter C are a pair of identically arranged apertures 22*b*. Directly beneath the blank 26*a* of block 12*b* is a portion 26*b* having no apertures. As a result, the coded symbol on the blocks at any point around the periphery of the cylindrical structure is identical from the bottom course to the top course. Thus six of each of the four symbols must be present on each course. Since the blocks of one course overlap and interlink with the blocks of vertically adjacent courses, the subsets illustrated in FIG. 1 are interlinked. For example, the subsets 2,5,8,11,14,17,20,23 are formed by the top course 18 of blocks. The subsets 1,4,7,10,13,16,19,22 are formed by the middle course 16 of blocks. Finally, the subsets 3,6,9,12, 15,18,21,24 are formed by the bottom course 14 of blocks. Although the embodiment shown in FIGS. 1-4 uses a set of four symbols forming 24 subsets of three symbols, it will be understood that other combinations may be utilized. For example, the set may consist of five symbols forming, for example, 60 subsets of three symbols.

The mathematical basis for the puzzle allows a systematic and logical approach to solving the puzzle. Since no symbol is repeated in a single subset, each symbol must be separated from an identical symbol by two other symbols. Thus, in initially assembling the blocks for the bottom course, blocks having identical symbols which are not separated from each other by two other symbols may not be placed end-to-end. Furthermore, since six of each of the four symbols in the set (ABCD) must be present on each course, an excess of one symbol and a corresponding deficiency in another symbol indicates that the blocks in the course cannot form a solution.

An alternative embodiment of the inventive puzzle having a set of two symbols arranged in subsets of four repeatable symbols is illustrated in FIG. 5. In this embodiment the puzzle pieces are formed by arcuate strips 30, and the symbols A,B are coded onto the strips by either the presence of a hole A or the absence of a hole B. Since the set of two symbols A,B are arranged in subsets of four repeatable symbols, sixteen unique subsets may be formed. The manner in which symbols of adjacent subsets are interlinked is best illustrated in FIG. 6. Note that three symbols in each subset of four symbols are interlinked unlike the puzzle of the first embodiment wherein two symbols in each subset are interlinked. For example, the symbols ABBBBAA are interlinked to form subset 30*d* (ABBB), subset 30*a* (BBBB), subset 30*e* (BBBA) and subset 30*g* (BBAA). This interlinking is accomplished by overlapping the strips to form a loop with three symbols from the subset of four symbols of each of the adjacent strips overlapping each other such that all vertically aligned symbols are identical. If desired, movable, upstanding rods (not shown), either mounted on bases or extending from holes in a game board, may be placed through vertically aligned holes to maintain the shape of the loop.

Another alternative embodiment of the puzzle is illustrated in FIG. 7. This embodiment is somewhat similar to the embodiment illustrated in FIGS. 5 and 6 inasmuch as the puzzle pieces are formed by arcuate strips 32 which are coded with apertures or holes. Instead of coding the symbols by the presence or absence of an aperture, however, the symbols are coded by providing apertures of differing shape. A square aperture 34 symbolizes the letter D, a triangular aperture 36 symbolizes the letter A, the absence of an aperture 38 symbolizes the letter C and a round aperture 40 symbolizes the letter B. The set consists of four symbols (ABCD) grouped in subsets of two non-repeating symbols. This coding scheme provides twelve unique subsets, one of which is contained on each of twelve strips. The strips are arranged in two staggered courses with six strips of each course. The staggered, overlapping strips link the symbols of the respective strips in the same manner as the staggered, overlapping blocks of the first embodiment link their respective symbols. In the puzzle of the third embodiment, a playing board 42 is provided having a plurality of holes arranged in a circle. Pegs 34',36',38' having round lower portions and upper portions shaped to correspond to the apertures 34,36,38 are inserted in the holes 44 to insure vertical alignment of identically coded symbols.

The embodiments of the invention in which a particular property or privilege is claimed are defined as follows:

1. A puzzle comprising a plurality of stacked pieces each having a subset of coded symbols taken from a set of said symbols, said coded symbols being present on both the top and bottom surfaces of said pieces with the top symbols of each piece being adapted to interface with matching symbols on the bottom of other pieces, said subsets being derived from said set such that said pieces, when arranged in a puzzle solution, mate with other pieces to form continuous loops with vertically mating pieces overlapping each other such that a plurality of bottom symbols of each piece match a plurality of top symbols of a mating piece adjacent one end thereof, and a plurality of top symbols of each piece match a plurality of bottom symbols of a mating piece adjacent the other end thereof.

2. The puzzle of claim 1 wherein top and bottom, vertically aligned symbols of each piece, have identical codes such that all of the vertically aligned symbols of a plurality of mating pieces have identical codes.

3. The puzzle of claim 2 wherein a plurality of courses are formed by arranging said pieces end-to-end to form a plurality of closed loops, said courses being stacked above each other with vertically adjacent pieces offset from each other such that portions of the coded symbols of one piece match portions of the coded symbols of at least two vertically adjacent pieces.

4. The puzzle of claim 3 wherein said top symbols are formed by pegs projecting from the top surface of said pieces, and said bottom symbols are formed by apertures in the bottom surface of said piece which correspond to, and are directly beneath, said top symbols.

5. The puzzle of claim 4 wherein said pegs and apertures are coded by providing a plurality of different peg and aperture shapes, each shape corresponding to one of said coded symbols.

6. The puzzle of claim 4 wherein said pegs and apertures are coded by providing a plurality of different peg and aperture arrangements, each arrangement corresponding to one of said coded symbols.

7. The puzzle of claim 3 wherein said set comprises four differently coded symbols and the subsets on each piece comprise three coded symbols taken from the set of four coded symbols.

8. The puzzle of claim 7 wherein said pieces are twenty-four in number, and wherein each subset utilizes three, non-repeated coded symbols such that each of said twenty-four pieces has a unique subset.

9. The puzzle of claim 2 wherein said pieces are relatively thin and are arranged in continuous loops with vertically adjacent pieces overlapping such that all vertically aligned coded symbols are identical.

10. The puzzle of claim 9 wherein said pieces are sixteen in number, each of which includes a subset of four coded symbols chosen from a set of two coded symbols.

11. The puzzle of claim 10 wherein each of said subsets are unique whereby the two coded symbols in said set are arranged in sixteen different combinations.

12. The puzzle of claim 11 wherein one coded symbol in said set is an aperture such that a vertically disposed rod may be placed through such vertically aligned symbols, and the other coded symbol in said set comprises the absence of an aperture.

13. The puzzle of claim 12 further including a plurality of movable alignment rods extending upwardly from a playing surface such that said rods may be positioned to extend through a plurality of vertically aligned apertures.

14. The puzzle of claim 11 wherein three symbols in the subset of each piece overlap with three symbols in the subset of each adjacent piece.

15. The puzzle of claim 1 wherein said symbols are coded by forming a plurality of differently shaped apertures through said piece, each shape corresponding to one of said codes.

16. The puzzle of claim 15 further including a playing surface having a plurality of holes in a loop corresponding to the loop formed by the arrangement of symbols on said pieces, said holes being adapted to support in an upright position a plurality of pegs corresponding to the shape of said coded apertures such that said pegs may be inserted through a plurality of matching, vertically aligned symbols.

* * * * *